US005359359A

United States Patent [19]

Dietrich et al.

[11] Patent Number: 5,359,359

[45] Date of Patent: Oct. 25, 1994

[54] DISPOSABLE POSTAGE METER ASSEMBLY

[75] Inventors: Klaus Dietrich; Stephan Günther; Norbert Knoth; Friedrich-Viktor Miehe; Wolfgang Thiel, all of Berlin, Fed. Rep. of Germany

[73] Assignee: Francotyp-Postalia GmbH, Berlin, Fed. Rep. of Germany

[21] Appl. No.: 838,489

[22] Filed: Feb. 19, 1992

[30] Foreign Application Priority Data

Feb. 19, 1991 [DE] Fed. Rep. of Germany ..... 4105497

[51] Int. Cl.[5] ..... B41J 29/40; G07B 17/04

[52] U.S. Cl. ..... 346/143; 101/91; 235/101; 364/464.02

[58] Field of Search ..... 346/140 R, 75, 143, 346/76 PH; 101/91; 400/70, 82, 126, 120; 235/101; 364/464.02, 918.52

[56] References Cited

U.S. PATENT DOCUMENTS

| | | | |
|---|---|---|---|
| 4,168,533 | 9/1979 | Schwartz | 364/464.02 |
| 4,580,144 | 4/1986 | Calvi | 346/76 PH |
| 4,581,616 | 4/1986 | Ross et al. | 346/76 PH |
| 4,858,138 | 4/1989 | Talmadge | 364/464.02 |
| 5,170,705 | 12/1992 | Haroutel | 101/91 |

*Primary Examiner*—Benjamin R. Fuller
*Assistant Examiner*—Alrick Bobb
*Attorney, Agent, or Firm*—Herbert L. Lerner; Laurence A. Greenberg

[57] ABSTRACT

A disposable postage meter assembly for printing charges and captions on envelopes and/or postage strips includes a base unit and a non-rechargeable disposable module. The base unit and the disposable module have devices for setting variable information.

11 Claims, 1 Drawing Sheet

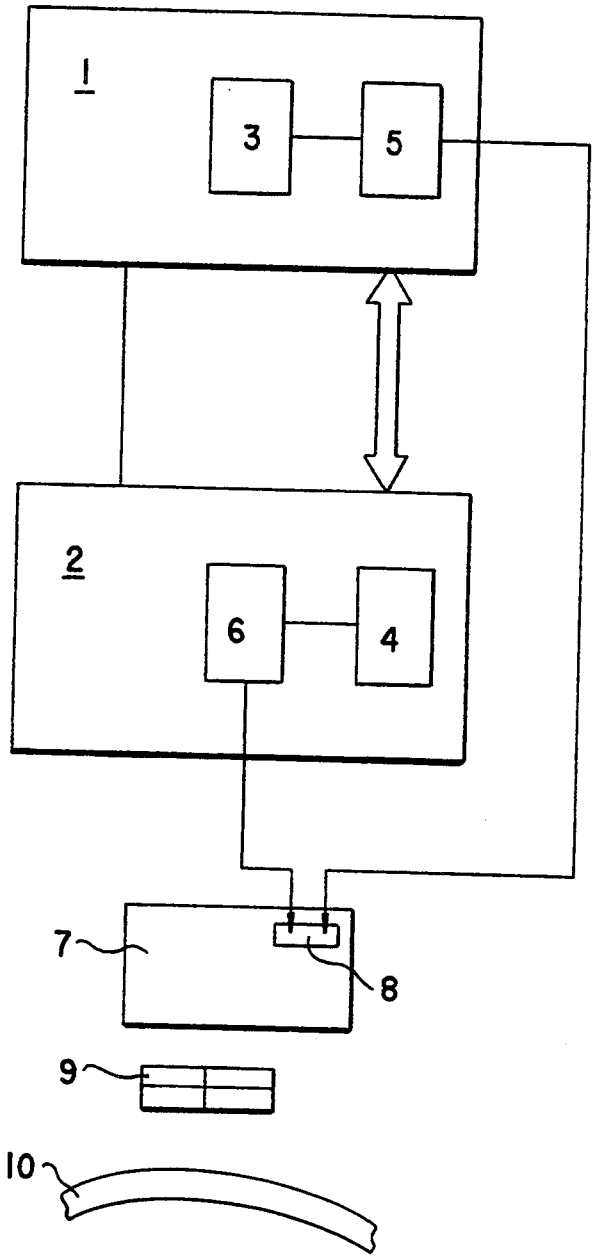
1
3
5
2
6
4
7
8
9
10

DISPOSABLE POSTAGE METER ASSEMBLY

SPECIFICATION

The invention relates to a disposable postage meter assembly for printing charges and captions on envelopes and/or postage strips.

Mailing equipment in the form of rechargeable postage meters, which receive credits for applying postage to mail by means of postage strips, electronic information carriers, such as chip cards, or remote deposit devices, are known in many versions.

Securing such machines against manipulations that are used to circumvent the credit balance entails major technological and commercial effort.

It is accordingly an object of the invention to provide a disposable postage meter assembly, which overcomes the hereinafore-mentioned disadvantages of the heretofore-known devices of this general type, which can issue postage up to a fixed credit amount and which is unusable thereafter, so that the effort for security involved in recharging is dispensed with.

With the foregoing and other objects in view there is provided, in accordance with the invention, a disposable postage meter assembly for printing charges and captions on envelopes and/or postage strips, comprising a base unit and a non-rechargeable disposable module, the base unit and the disposable module having means for setting variable information.

Dividing the postage meter assembly into a disposable module and a base unit makes extensive security measures for replenishing the credit amounts unnecessary.

In accordance with another feature of the invention, the disposable module has means for printing a complete postage imprint and security information.

In accordance with a further feature of the invention, the disposable module has means for printing variable information regarding charges, dates and security information, such as a location stamp and a charge boundary, and the base unit has a print head for printing non-variable or limitedly variable information regarding an adresser, advertising and manner of mailing.

In accordance with an added feature of the invention, the disposable module has means for exclusively printing variable information regarding charges and dates, and the base unit has a print head for printing all other information.

In accordance with an additional feature of the invention, the printing means of the disposable module is an ink jet printer.

In accordance with yet another feature of the invention, the printing means of the disposable module is a thermal transfer printer.

In accordance with yet a further feature of the invention, there is provided a pre-impregnated thermal tape associated with the disposable module being automatically destroyed after a credit amount of the disposable module has been used up.

In accordance with yet an added feature of the invention, there are provided pre-printed strips with colored captions on which a postage imprint is to be printed.

In accordance with yet an additional feature of the invention, the base unit has means for setting the variable information in the disposable module and in the base unit.

In accordance with a concomitant feature of the invention, the disposable module has means for setting variable postage imprint information.

Other features which are considered as characteristic for the invention are set forth in the appended claims.

Although the invention is illustrated and described herein as embodied in a disposable postage meter assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

The drawing is a block circuit diagram of a disposable postage meter assembly according to the invention with a diagrammatic view of items to be imprinted.

Referring now to the single FIGURE of the drawing in detail, there is seen one of several different embodiments of a base unit 1 and a disposable module 2 of the invention. To a certain extent, for information that does not involve security, the base unit 1 can be recharged.

In principle, the disposable module 2 prints on strips 9, such as adhesive strips on a backing paper, that are applied separately to envelopes or packages, and it also prints directly onto an envelope 7.

The disposable module 2 is constructed in different variant ways.

The comprehensive disposable module 2 prints a complete postage imprint 8 with the security information, which may be a boundary around the charge. This means that the charge value with the boundary, the location stamp, the date, captions such as the sender or advertising, and the manner of mailing, are imprinted by a print head 6 of the disposable module 2.

A second variant of the disposable module 2 is capable of printing a postage imprint 8 with only the charge value, the charge boundary, the location stamp and the date. The captions and the manner of mailing are printed by a print head 5 of the base unit 1 or are already incorporated in the postage strips 9 which are ready for imprinting.

A third variant of the disposable module 2 is characterized by exclusively imprinting a postage imprint 8 with information, specifically the charges and the date.

The print heads 6 of these disposable modules 2 are part of printers that can be programmable in a practical manner. Preferably, heat-transfer and ink-jet methods are employed. In the case of an embodiment to be used solely for imprinting postage strips, pin-type printers such as dot-matrix printers, can also be used.

The variant of the disposable module 2 for printing only the variable information is the most economical version. Printing variable information requires a less sophisticated print head 6, such as a thermal serial type or a high-pressure ink jet type. In a thermal transfer printing method, a wax-coated tape 10 is used, from which the heating elements of the thermal pressure head 6 melt out the ink in dots. Such a tape 10 can be pre-impregnated, for instance by having characters and numerals in already-molten and thus imprintable form. This provides the effect of fast imprinting of these parts of the printed image or imprint 8, with high resolution. The printer of the disposable module 2 for printing the variable information can then have a lower resolution.

Another advantage of this variant is that the entire printing width of the postage imprint 8 is no longer necessary for printing the variable information, and therefore a narrower print head 6 can be used for the disposable module 2.

Pre-impregnated tapes 10 of this kind are integrated in the disposable module 2 for security reasons and are automatically destroyed once the credit amount in the disposable module 2 has been used up.

Instead of pre-impregnated tapes 10, pre-printed strips 9 which may optionally have captions in color are also usable.

Dividing the postage meter assembly into a disposable module 2 and a base unit 1 has the advantage of producing an economical disposable module 2 that prints only the variable information, while a higher-performance print head 5 in terms of resolution and printing width can be used for the standard information in the base unit 1. This printing head can then be variable in terms of the offset imprint as well, without entailing effort and expense for security. Moreover, the base unit 1 has necessary means 3 for setting the variable information in the base unit 1 and optionally in the disposable module 2 as well.

In countries in which the postal service does not allow additional captions and/or advertising offsets for postage meters, the base unit 1 can be dispensed with entirely. In that case, means 4 for setting the charge and date figures should be assigned to the disposable module 2.

Once the credit in the disposable module 2 has been exhausted, the module 2 can be destroyed or returned to the manufacturer.

We claim:

1. A disposable postage meter assembly for printing charges and captions on envelopes postage strips, comprising a base unit and a non-rechargeable disposable module, said base unit and said disposable module having means for setting variable information, said disposable module having means for printing variable information regarding charges, dates and security information, and said base unit having a print head for printing at least partially limitedly variable information regarding an adresser, advertising and manner of mailing.

2. The disposable postage meter assembly according to claim 1, wherein said disposable module has means for printing a complete postage imprint and security information.

3. The disposable postage meter assembly according to claim 1, wherein said variable information includes a location stamp and a charge boundary, and said at least partially limitedly variable information is non-variable information.

4. The disposable postage meter assembly according to claim 1, wherein said printing means of said disposable module is an ink jet printer.

5. The disposable postage meter assembly according to claim 1, wherein said printing means of said disposable module is a thermal transfer printer.

6. The disposable postage meter assembly according to claim 5, including a pre-impregnated thermal tape associated with said disposable module being automatically destroyed after a credit amount of said disposable module has been used up.

7. The disposable postage meter assembly according to claim 4, including pre-printed strips with colored captions on which a postage imprint is to be printed.

8. The disposable postage meter assembly according to claim 5, including pre-printed strips with colored captions on which a postage imprint is to be printed.

9. The disposable postage meter assembly according to claim 1, wherein said base unit has means for setting the variable information in said disposable module and in said base unit.

10. The disposable postage meter assembly according to claim 1, wherein said disposable module has means for setting variable postage imprint information.

11. A disposable postage meter assembly for printing charges and captions on envelopes postage strips, comprising a base unit and a non-rechargeable disposable module, said base unit and said disposable module having means for setting variable information, said disposable module having thermal transfer printer means for exclusively printing variable information regarding charges and dates, said base unit having a print head for printing non-variable information, and including a pre-impregnated thermal tape associated with said disposable module being automatically destroyed after a credit amount of said disposable module has been used up.

* * * * *